US011502454B2

(12) United States Patent
Ambalam et al.

(10) Patent No.: US 11,502,454 B2
(45) Date of Patent: Nov. 15, 2022

(54) SELF-LATCHING POWER CORD FOR APPLIANCES

(71) Applicant: WHIRLPOOL CORPORATION, Benton Harbor, MI (US)

(72) Inventors: Harikrishna Ambalam, Stevensville, MI (US); Scott Patrick Kokoska, South Bend, IN (US); Varun D. Kuvalekar, Benton Harbor, MI (US); Vishal Madkaikar, Benton Harbor, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 0 days.

(21) Appl. No.: 17/196,630

(22) Filed: Mar. 9, 2021

(65) Prior Publication Data

US 2022/0294158 A1 Sep. 15, 2022

(51) Int. Cl.
*H01R 13/62* (2006.01)
*H01R 13/627* (2006.01)
*H01R 13/639* (2006.01)

(52) U.S. Cl.
CPC ..... *H01R 13/6277* (2013.01); *H01R 13/6397* (2013.01)

(58) Field of Classification Search
None
See application file for complete search history.

(56) References Cited

U.S. PATENT DOCUMENTS

| | | | | |
|---|---|---|---|---|
| 5,984,705 | A * | 11/1999 | Miyazaki | H01R 13/703 340/687 |
| 6,200,155 | B1 | 3/2001 | Chudkosky et al. | |
| 7,611,370 | B2 | 11/2009 | Ito et al. | |
| 7,682,191 | B2 | 3/2010 | Iwahori et al. | |
| 8,277,234 | B2 | 10/2012 | Hopwood et al. | |
| 8,382,492 | B2 | 2/2013 | Hering et al. | |
| 10,153,587 | B1 | 12/2018 | Lai | |
| 10,270,214 | B2 | 4/2019 | Jiang | |
| 2004/0248462 | A1* | 12/2004 | Dyer | H01R 29/00 439/502 |
| 2005/0250375 | A1 | 11/2005 | Allison | |
| 2019/0229461 | A1 | 7/2019 | Lu et al. | |

* cited by examiner

*Primary Examiner* — Ross N Gushi
(74) *Attorney, Agent, or Firm* — Brooks Kushman, P.C.

(57) ABSTRACT

An appliance cord assembly may include a first cord portion including a plug at one end configured to be received by a wall outlet and a plug mount at the opposite end, a second cord portion including a captive end hardwired to an appliance and a free end connected to a panel mount, the panel mount being configured to connect with the plug mount of the first cord portion to create a conductive engagement with the plug mount, such that in the connected state, the plug mount and the panel mount define a key opening, and a service tool configured to be received by the key opening to disconnect the panel mount and plug mount.

20 Claims, 5 Drawing Sheets

SELF-LATCHING POWER CORD FOR APPLIANCES

TECHNICAL FIELD

Disclosed herein are self-latching power cords for appliances.

BACKGROUND

Household appliances typically draw power from a wall outlet. Upon installation, the appliance is mated with the wall outlet to draw power for operation. Various regions and geographical locations have varying power supplies, regulations, and consumer preferences. Thus, each power cord may be specific to the respective region in which the appliance is to be installed. Current power cords for appliances are traditionally hardwired into units and connected to the actuator control unit (ACU).

SUMMARY

An appliance cord assembly may include a first cord portion including a plug at one end configured to be received by a wall outlet and a plug mount at the opposite end, a second cord portion including a captive end hardwired to an appliance and a free end connected to a panel mount, the panel mount being configured to connect with the plug mount of the first cord portion to create a conductive engagement with the plug mount, such that in the connected state, the plug mount and the panel mount define a key opening, and a service tool configured to be received by the key opening to disconnect the panel mount and plug mount.

A universal appliance cord assembly for applicability across multiple geographic locations, may include a first cord portion including a plug at one end configured to be received by a wall outlet and a plug mount at the opposite end, where the wall outlet is specific to a geographic location and the plug is configured to mate with the geographically specific wall outlet, a second universal cord portion including a captive end hardwired to an appliance and a free end connected to a panel mount, the panel mount being configured to connect with the plug mount of the first cord portion to create a conductive engagement with the plug mount, such that in the connected state, the plug mount and the panel mount define a key opening, and a service tool configured to be received by the key opening to disconnect the panel mount and plug mount, wherein once the panel mount and the plug mount are in the connected state, the panel mount and the plug mount are maintained in the connected state until the service tool is received by the key opening.

An appliance cord assembly may include a first cord portion including a plug at one end configured to be received by a wall outlet and a plug mount at the opposite end, a second cord portion including a captive end hardwired to an appliance and a free end connected to a panel mount, the panel mount being configured to connect with the plug mount of the first cord portion to create a conductive engagement with the plug mount, such that in the connected state, the plug mount and the panel mount define a key opening, wherein the panel mount includes a panel lip extending upward from a periphery of the panel mount and the plug mount includes a plug lip extending upward from a periphery of the plug mount and is configured to overlap with the panel lip in the connected state, and a service tool configured to be received by the key opening and abut the mount lip to pry the panel lip away from the plug mount to disengage the panel mount from the plug mount.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Current power cords are traditionally hardwired into a home appliance. However, the specifications for the power cord may vary based on the country or area the appliance is to be installed. Various plug types, current ratings, cord types, connection types, mounting types, color, length restrictions, voltages, etc., may be required depending on the installation location of the appliance. In North America, specifically in the United States, an AB plug, 120V, 50 Hz cable is required. In Europe, however, C, F and E plug types may be used with 230V/50 Hz requirements.

These location specific requirements result in hundreds of different power cords being used to deliver power to the appliances. During manufacturing, the location-specific cord is required to be hardwired to the appliance. However, this limits the ability to sell an appliance to a location other than that for which the specific power cord is designed for. This may limit inventory, create excess inventory, require more parts (e.g., more power cords), and generally require the appliance to be location specific.

Disclosed herein is a power cord assembly for an appliance that includes a latching system between an appliance portion of the power cord, and a plug portion of the power cord. The appliance portion includes a cord or panel mount that is hard wired to the appliance. The plug portion includes a cord connected to a plug on one end and a plug mount on the opposite end. The plug mount is configured to mate with the panel mount so that power may be transmitted from a wall outlet through the mounts and to the appliance. The plug portion may have varying plug configurations and specifications depending on the location of installation of the appliance. Thus, with varying geographic (e.g., country, continent), the source portion will change. The appliance portion, however, is configured to remain constant across all regions, allowing only the source portion to change with the differing electrical requirements.

Because of this, the appliance may be more universally sold. Furthermore, the latch may provide for protection against dirt and moisture and may only be uninstalled or separated with a manufacturer's tool. This provides additional safety, as well as a semi-permanent cord attachment system.

Figure 1:
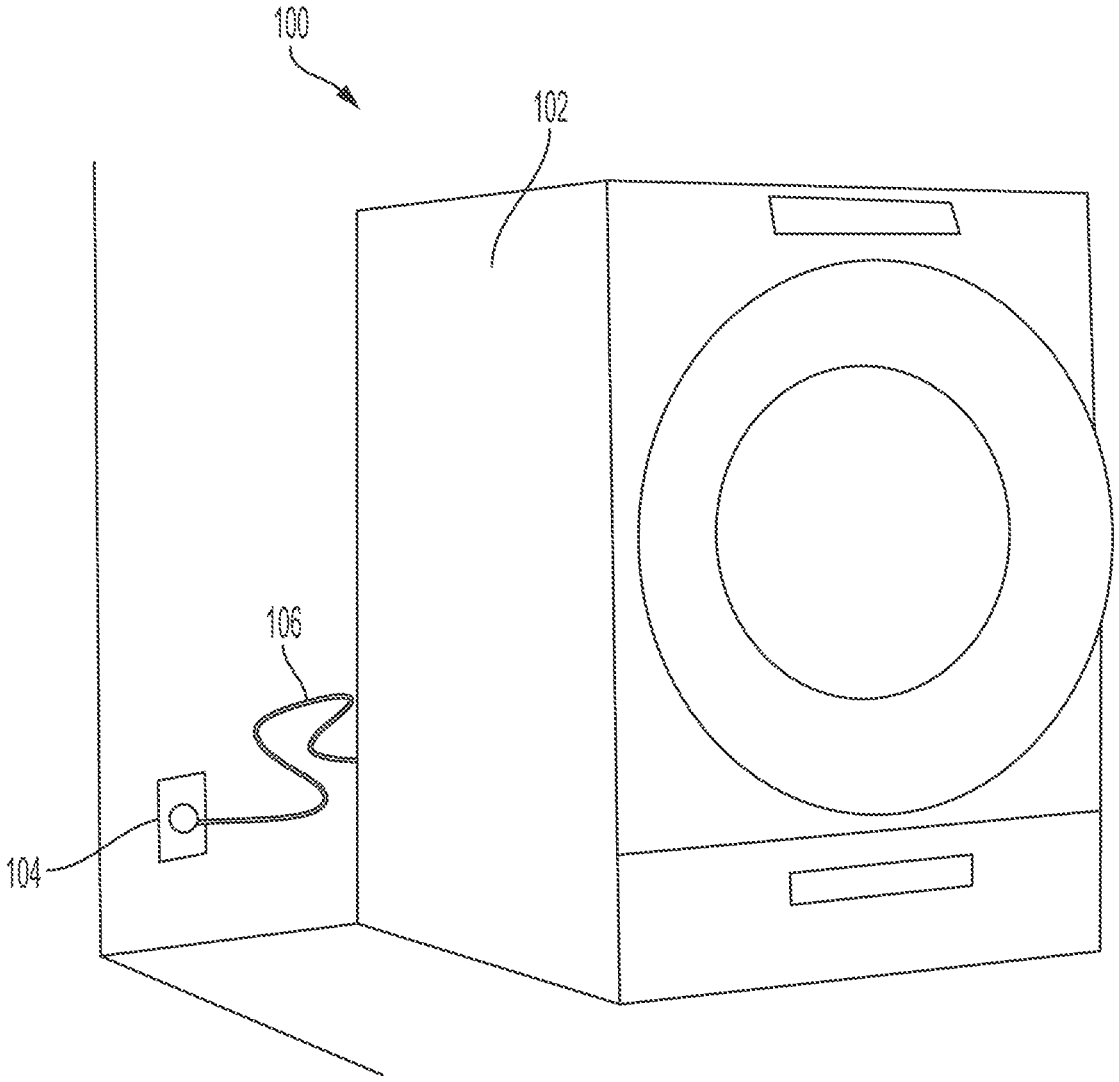
FIG. 1 illustrates an example front perspective view of a household appliance and a wall power source connected via a power cord assembly.

FIG. 1 illustrates an example front perspective view of a household appliance 102 and a wall outlet power source 104 connected via a power cord assembly 106. The appliance 102 may include any household or commercial appliance, such as a dryer, washer, dishwasher, refrigerator, freezer, oven, microwave, ice maker, range, trash compactor, range hood, beverage cooler, among others. The appliance 102 is configured to receive power through the power cord assembly 106. The power cord assembly 106 may include a captive end at the appliance and a free end having a plug to plug into the wall power source 104. Based on the country, continent, or area, the wall outlet 104 may provide varying voltages and currents, thus requiring the power cord assembly 106 to be rated for such power. The power cord assembly 106 is discussed in more detail herein.

Figure 2:
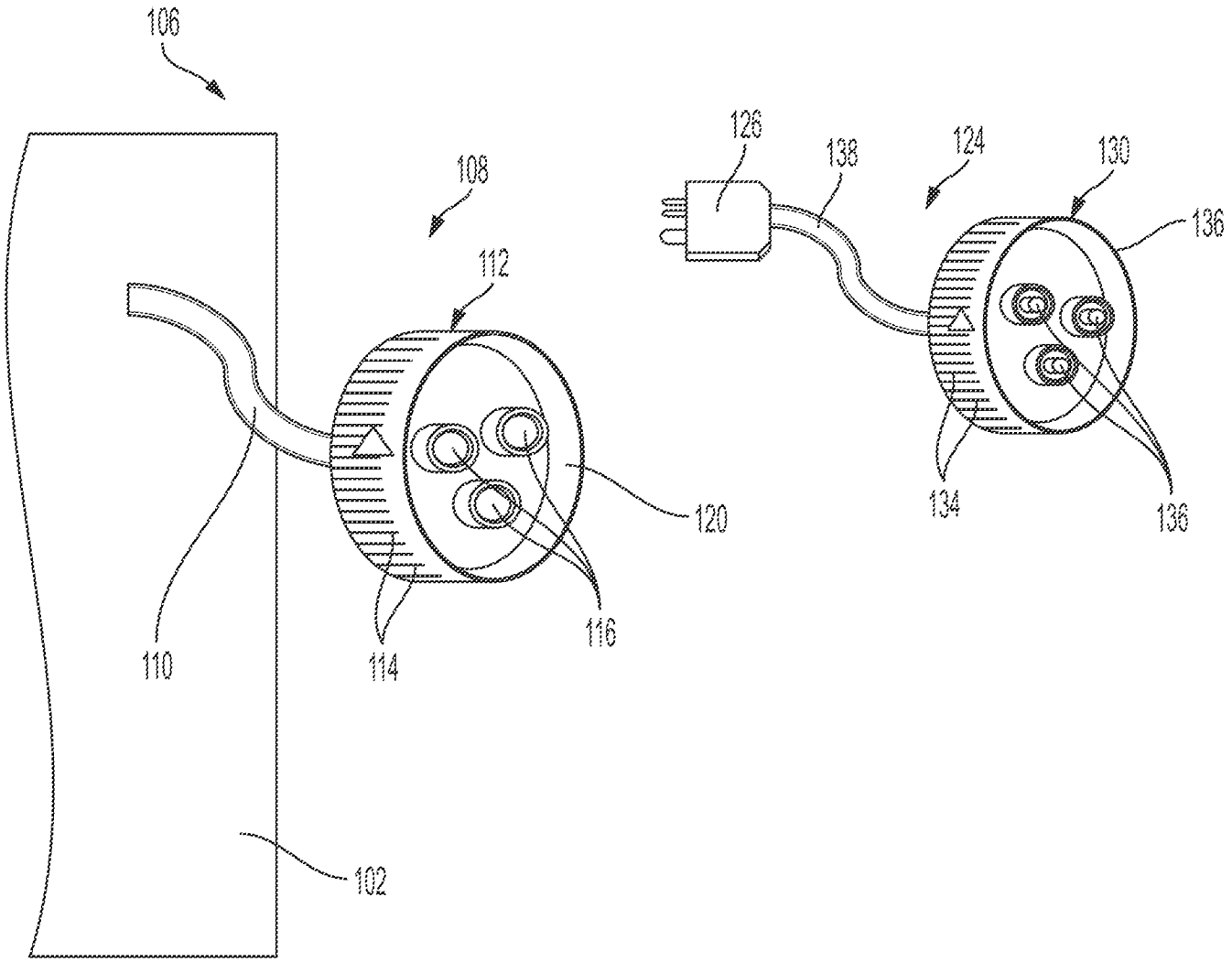
FIG. 2 illustrates a perspective view of the cord assembly in an unattached state.
Figure 6:
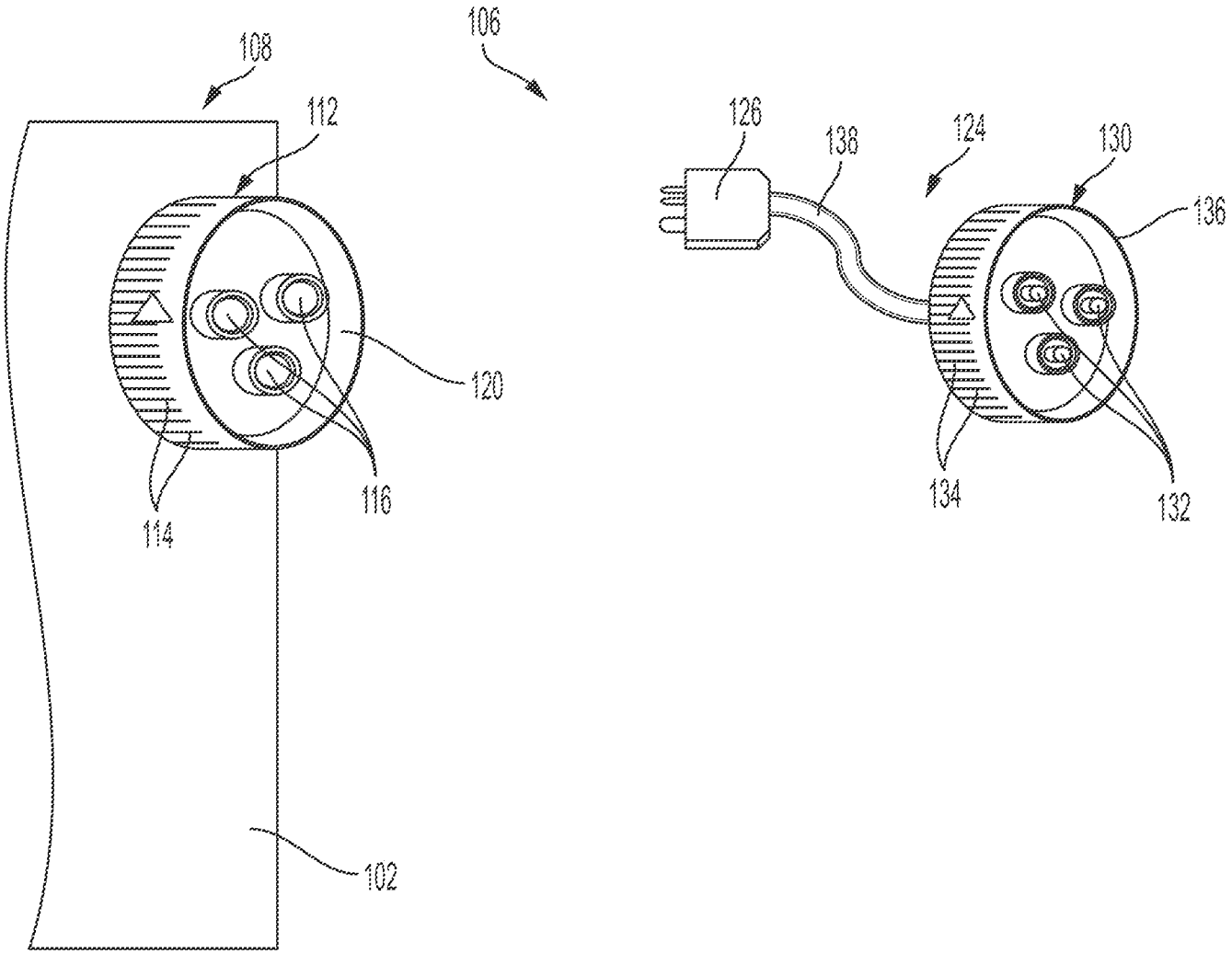
FIG. 6 illustrates a perspective view of another example cord assembly in a detaching state.

FIG. 2 illustrates a perspective view of the cord assembly 106 in an unattached state. The power cord assembly 106 may include two portions. A first portion, or appliance portion 108, may be hardwired to the appliance 102. This may be done during manufacturing and prior to delivery of the appliance 102 to the buyer. The appliance portion 108 may be attached to the appliance 102 at a first end. A panel mount 112 may be arranged at the opposite second end. In some examples, as shown in FIG. 2, the panel mount may connect to the appliance 102 via an appliance cord 110. The cord 110 may be a wire to wire connector attached to the power cord of the appliance 102. In another example, as shown in FIG. 6, the panel mount 112 may be connected directly to the appliance 102.

The panel mount 112 may form a disk-like shape having a round periphery. The perimeter of the panel mount 112 may include a plurality of ridges 114 creating a ribbed-like surface therearound. A plurality of terminals 116 are arranged in the center of the disk. The terminals 116 may be configured to conduct electricity and allow electricity to pass therethrough to the appliance 102.

The panel mount 112 may form a silo around the terminals 116 via a first lip 120. The lip 120 may extend upward from the periphery such that the height of the lip 120 is greater than the height of the terminals 116. The lip 120 may form a protective shield around the terminals 116. This shield may protect the terminals 116 from becoming bent, or otherwise damaged during installation, travel, delivery, etc. The terminals 116 are illustrated as including three terminals 216, but more or fewer terminals 116 may be included.

The power cord assembly 106 may also include a second portion, or source portion. The plug portion 124 may include a captive end, or plug 126 configured to be received by the wall outlet 104 to draw power therefrom. The plug 126 may draw from the power supplied by the wall outlet 104 and that power may depend on the country, region, continent, etc. Furthermore, the plug 126 may be a specific type, including a specific arrangement of pins. The plug portion 124 of the power cord assembly 106 may therefore be specific to the country in order to be compatible with the power source (e.g., voltage, current, etc.).

At the other end of the plug portion 124, a plug mount 130 may be arranged and include a plurality of plug terminals 132. Similar to the panel mount 112, the plug mount 130 may form a disk-like shape having a round periphery. The perimeter of the plug mount 130 may include a plurality of ridges 134 creating a ribbed-like surface therearound. The terminals 132 are arranged in the center of the disk. The terminals 132 may be configured to conduct electricity from wall outlet 104.

The plug mount 130 may also form a silo around the terminals 132 via a second lip 136. The lip 132 may extend upward from the periphery such that the height of the lip 132 is greater than the height of the terminals 132. The lip 132 may form a protective shield around the terminals 132. This shield may protect the terminals 132 from becoming bent, or otherwise damaged during installation, travel, delivery, etc. The terminals 132 are illustrated as including three terminals 216, but more or less terminals 116 may be included.

The plug terminals 132 include male-type projections configured to extend outward from the disk. The mount terminals 116, on the other hand, may project from the disk but include female-type recesses configured to receive the male projections of the plug terminals 132. For this male/female mating, the plug terminals 132 and the mount terminals 116 may be similarly arranged within their respective disks such that the terminals align with one another. The terminals 116, 132 may create a poka-yoke arrangement to allow for the proper orientation and alignment. The male and female arrangements could be switched where the plug terminals 132 are female-type terminals and the mount terminals 116 are male-type terminals. Further, if the plug terminals 132 are not engaged with the mount terminals 116, power may cease to transmit therefrom.

While the panel mount 112 and the plug mount 130 have similar shapes, the diameter of the plug mount 130 may be greater than the diameter of the panel mount 112. This may be, at least in part, so in the installed or mated state, the second lip 136 at least partially overlaps the first lip 120. This is described in more detail below.

Figure 3:
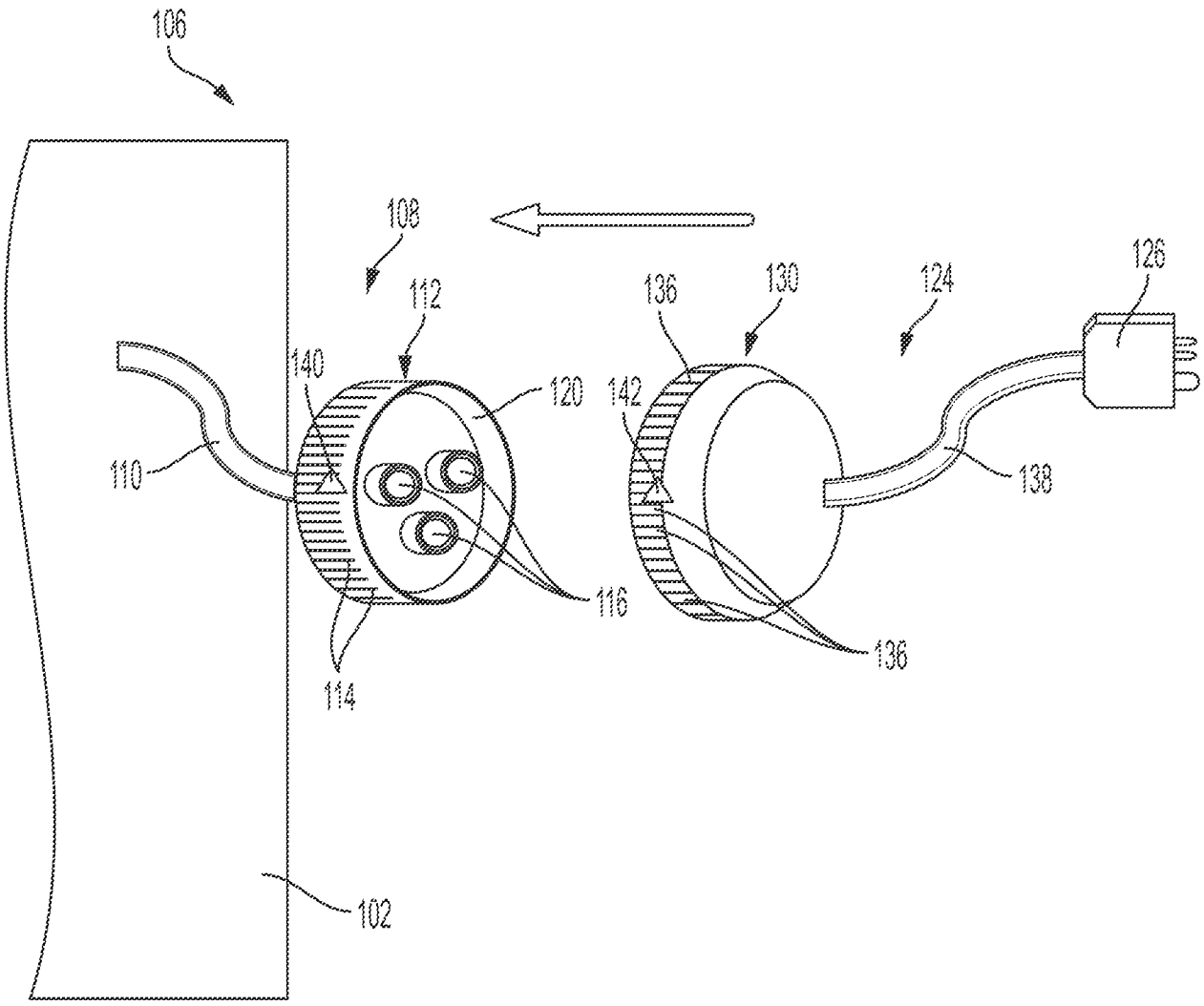
FIG. 3 illustrates a perspective view of the cord assembly in an unattached state.
Figure 4:
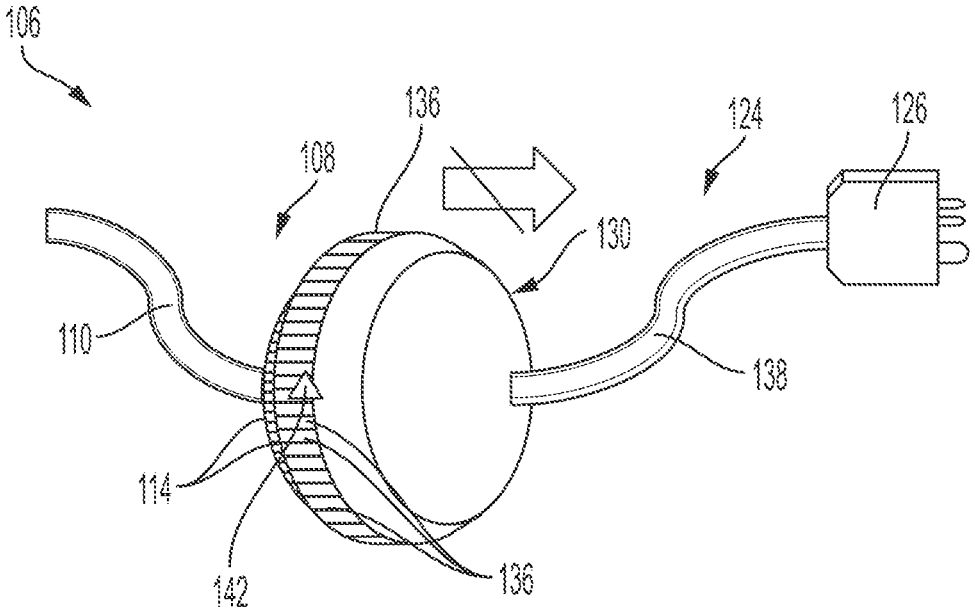
FIG. 4 illustrates a perspective view of the cord assembly in an attached state.

FIG. 3 illustrates a perspective view of the cord assembly 106 in an unattached state. FIG. 4 illustrates a perspective view of the cord assembly 106 in an attached state. As illustrated, the plug portion 124 may include the plug cord 138 connecting the plug mount 130 to the plug 126. The cord 138 may be rated to transmit power from the outlet 104 to the plug mount 130.

In the installed state, as best illustrated in FIG. 4, the plug mount 130 may mate with the panel mount 112. The male projections of the plug terminals 132 may be received by the female recesses of the panel mount 112. Upon the male projections being seated within the female recesses, the second lip 130 may slide over the panel mount 112 allowing the second lip 130 to at least partially overlap the first lip 120. In allowing the panel mount 112 to be encased in the plug mount 130, the latched mechanism prevents dirt, moisture, fluids, or debris from coming into contact with the terminals 116, 132.

In the attached state, the cord assembly 106 may allow power to flow from the wall outlet 104 to the appliance 102 via the conductive connections created by the latching of the panel mount 112 and the plug mount 130. The panel mount 112 may be configured to receive varying specifications of power, plug types, etc. Thus, regardless of the power specifications for the specific country, the panel mount 112 may remain generally consistent during manufacturing. That is, the panel mount 112 may be the same for most appliances and allow for a more universal part. The exception to this is for different voltage and current ratings. For example, the panel mount 112 may vary between 120V and a 240V appliance. The terminals 116 of the panel mount may vary between these two required voltages to prevent an incorrect attachment during installation. However, some appliances may be capable of handling both 120V and 240V supplies.

Each of the panel mount 112 and the plug mount 130 may define a key opening on the respective outer periphery. The panel key opening 140 and the plug key opening 142 may be a hole or aperture for receiving a service tool (the openings 140, 142 individually illustrated in FIG. 3). The openings 140, 142 may provide access to a locking mechanism configured to latch and lock the mounts 112, 130 together. Once the panel mount 112 and the plug mount 130 are latched or mated, the openings 140, 142 may overlap and align, as best shown in FIG. 4. The ridges 114, 134 on each of the mounts 112, 130 may create a further frictional fit between the mounts 112, 130 and prevent the mounts from radially twisting with respect to one another, as well as help prevent lateral movement as well. Once the mounts 112, 130 have been attached, the cord assembly 106 may be permanently latched, creating a sealed, secure cord assembly 106. In another example, the mounts 112, 130 may be detached using a specially keyed service tool.

In the attached, or latched, state, power may transmit from the plug 126, through the plug mount 130 to the panel mount 112, and then to the appliance 102. The cord 110 may connect to the appliance actuator control unit (ACU). This may be done via a terminal block (not shown), or other connection mechanism typically already installed in the appliance 102.

Once the mounts 112, 130 are latched, the mounts 112, 130 may not be separated. This may be important to prevent power leakages or potentially unsafe conditions should the cord assembly come into contact with water.

Figure 5:
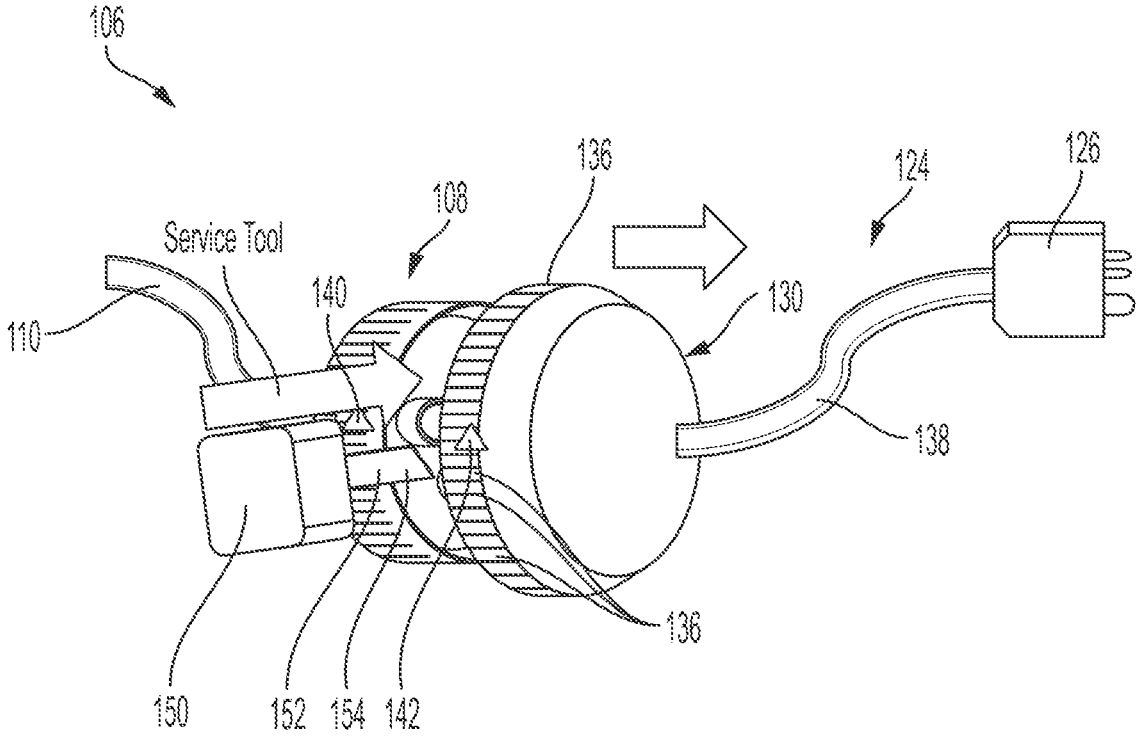
FIG. 5 illustrates a perspective view of the cord assembly in a detaching state.

FIG. 5 illustrates a perspective view of the cord assembly 106 in a detaching state. Once the cord assembly 106 is latched, the assembly 106 may not be separated without an appropriate service tool 150. The service tool 150 may include a key 152 insertable into the openings 140, 142 to 'unlock' the latching engagement between the mounts 112, 130. The key 152 may have a profile similar to that of the openings 140, 142. In the figures, for example, the profile may be a triangular profile. A tip 154 of the key 152 may be an angled projection such that, once inserted into the openings 140, 142, the tip 154 may pry or leverage the first lip 120 away from the plug mount 130 in order to pry the panel mount 112 away from the plug mount 130.

In some examples, the service tool 150 may be a screwdriver. The openings 140, 142 may be sized to receive the shaft of a screwdriver and a Phillips head tip may depress a locking mechanism to release the two mounts 112, 130 from one another. In another example, the screw driver may be twisted to unscrew a locking mechanism.

The service tool 152 may be only available to manufacturers and technicians. Thus, the cord assembly 106 may only be separated under certain circumstances and only done so by a professional.

FIG. 6 illustrates a perspective view of another example cord assembly 106 in a detaching state. In this example, the panel mount 112 may not include a cord 110, but rather, be installed directly to the ACU/terminal block within the appliance 102. While the service tool 152 is shown as having a certain shape, other shapes, cross sections, key forms, etc., may be possible.

Also, while the appliance portion 108 is illustrated as being attached a side of an appliance, the appliance portion 108 may be attached at any part of the appliance, such as the top, bottom, etc. The cord assembly 106 may be mounted to the appliance horizontally as well as vertically, or at an angle, if necessary.

Accordingly, a power cord assembly for an appliance is disclosed herein. The cord assembly includes a first and second portion configured to latch together. The first portion may be universal and attached to the appliance. The second portion may be rated for the specific power requirements of the country, region, continent, etc. Once, latched, the two portions may only be detachable with the use of a specially keyed service tool.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

The flowcharts and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

What is claimed is:

1. An appliance cord assembly, comprising:

a first cord portion including a plug at one end configured to be received by a wall outlet and a plug mount at the opposite end;

a second cord portion including a captive end hardwired to an appliance and a free end connected to a panel mount, the panel mount being configured to connect with the plug mount of the first cord portion to create a conductive engagement with the plug mount, such that in the connected state, the plug mount and the panel mount define a key opening;

wherein the panel mount includes a panel lip extending upward from a periphery of the panel mount and the plug mount includes a plug lip extending upward from a periphery of the plug mount and is configured to overlap with the panel lip in the connected state; and a service tool configured to be received by the key opening to pry the panel mount away from the plug mount.

2. The assembly of claim 1, wherein the service tool includes a key portion configured to correspond to the cross-section of the key opening.

3. The assembly of claim 2, wherein the key portion includes a pointed tip configured to, once inserted into the key opening, engage with and move the panel mount away from the plug mount.

4. The assembly of claim 1, wherein the plug mount defines a plug opening and the panel mount defines a panel opening, in the connected state the plug opening and the panel opening align to create the key opening.

5. The assembly of claim 1, further comprising a locking mechanism configured to lock the plug mount to the panel mount.

6. The assembly of claim 1, wherein the panel mount includes panel terminals.

7. The assembly of claim 6, wherein the plug mount includes plug terminals configured to engage with the panel terminals in the connected state to provide the conductive engagement between the plug mount and the panel mount.

8. The assembly of claim 7, wherein one of the plug terminals and the panel terminals forms male-type projections and the other forms female-type projections so that the female-type projections receive the male-type projections in the connected state.

9. The assembly of claim 7, wherein the panel mount defines a panel lip extending upward from a periphery of the panel mount.

10. The assembly of claim 9, wherein the panel lip has a height greater than that of the panel terminals where the lip provides a shield around the panel terminals.

11. The assembly of claim 9, wherein the plug mount includes a plug lip extending upward from a periphery of the plug mount and is configured to overlap with the panel lip in the connected state.

12. A universal appliance cord assembly for applicability across multiple geographic locations, comprising:

a first cord portion including a plug at one end configured to be received by a wall outlet and a plug mount at the opposite end, where the wall outlet is specific to a geographic location and the plug is configured to mate with the geographically specific wall outlet;

a second universal cord portion including a captive end hardwired to an appliance and a free end connected to a panel mount, the panel mount being configured to connect with the plug mount of the first cord portion to create a conductive engagement with the plug mount, such that in the connected state, the plug mount and the panel mount define a key opening; and a service tool configured to be received by the key opening and abut the panel mount to pry the panel mount away from the plug mount, wherein once the panel mount and the plug mount are in the connected state, the panel mount and the plug mount are maintained in the connected state until the service tool is received by the key opening.

13. The assembly of claim 12, wherein the service tool includes a key portion configured to correspond to the cross-section of the key opening.

14. The assembly of claim 13, wherein the key portion includes a pointed tip configured to, once inserted into the key opening, engage with and move the panel mount away from the plug mount.

15. The assembly of claim 12, wherein the plug mount defines a plug opening and the panel mount defines a panel opening, in the connected state the plug opening and the panel opening align to create the key opening.

16. The assembly of claim 12, further comprising a locking mechanism configured to lock the plug mount to the panel mount.

17. The assembly of claim 12, wherein the panel mount includes panel terminals and the plug mount includes plug terminals configured to engage with the panel terminals in the connected state to provide the conductive engagement between the plug mount and the panel mount.

18. The assembly of claim 17, wherein one of the plug terminals and the panel terminals forms male-type projections and the other forms female-type projections so that the female-type projections receive the male-type projections in the connected state.

19. The assembly of claim 17, wherein the panel mount defines a panel lip extending upward from a periphery of the panel mount and wherein the panel lip has a height greater than that of the panel terminals where the lip provides a shield around the panel terminals.

20. An appliance cord assembly, comprising:

a first cord portion including a plug at one end configured to be received by a wall outlet and a plug mount at the opposite end;

a second cord portion including a captive end hardwired to an appliance and a free end connected to a panel mount, the panel mount being configured to connect with the plug mount of the first cord portion to create a conductive engagement with the plug mount, such that in the connected state, the plug mount and the panel mount define a key opening, wherein the panel mount includes a panel lip extending upward from a periphery of the panel mount and the plug mount includes a plug lip extending upward from a periphery of the plug mount and is configured to overlap with the panel lip in the connected state; and a service tool configured to be received by the key opening and abut the mount lip to pry the panel lip away from the plug lip to disengage the panel mount from the plug mount.

* * * * *